US008172094B2

(12) United States Patent
Meyer et al.

(10) Patent No.: US 8,172,094 B2
(45) Date of Patent: May 8, 2012

(54) PRODUCT DISPLAY SYSTEM

(75) Inventors: Scott Meyer, Minneapolis, MN (US); Andy Vartanian, Yardley, PA (US)

(73) Assignee: Target Brands, Inc., Minneapolis, MN (US)

( * ) Notice: Subject to any disclaimer, the term of this patent is extended or adjusted under 35 U.S.C. 154(b) by 415 days.

(21) Appl. No.: 12/420,239

(22) Filed: Apr. 8, 2009

(65) Prior Publication Data

US 2010/0258513 A1 Oct. 14, 2010

(51) Int. Cl.
*A47F 1/04* (2006.01)

(52) U.S. Cl. ..... 211/59.3; 211/134

(58) Field of Classification Search ..... 211/184, 211/59.3, 51, 59.4, 175; 312/61, 71; 108/60, 108/61; 221/226, 279
See application file for complete search history.

(56) References Cited

U.S. PATENT DOCUMENTS 1,523,136 A * 1/1925 O'Connor ..... 220/533
2,079,754 A 5/1937 Wasgiser
2,915,193 A * 12/1959 Bromberg ..... 108/61
3,827,574 A * 8/1974 Craig, Sr. ..... 211/184
4,757,915 A * 7/1988 Albright et al. ..... 221/75
4,830,201 A 5/1989 Breslow
4,901,869 A 2/1990 Hawkinson et al.
5,110,192 A * 5/1992 Lauterbach ..... 312/71
5,190,186 A 3/1993 Yablans et al.
5,203,463 A * 4/1993 Gold ..... 211/59.3
5,265,738 A 11/1993 Yablans et al.
5,353,939 A * 10/1994 Beeler et al. ..... 211/59.3
5,366,099 A 11/1994 Schmid
5,582,305 A * 12/1996 Howell et al. ..... 211/126.1
5,613,621 A 3/1997 Gervasi
5,673,801 A 10/1997 Markson
5,881,910 A 3/1999 Rein
6,041,720 A 3/2000 Hardy
6,047,647 A * 4/2000 Laraia, Jr. ..... 108/61
6,116,436 A 9/2000 Ferrucci et al.
6,129,218 A 10/2000 Henry et al.
6,234,328 B1 5/2001 Mason
6,409,028 B2 6/2002 Nickerson
6,523,703 B1 2/2003 Robertson
6,533,131 B2 3/2003 Bada
6,655,536 B2 12/2003 Jo et al.
6,692,091 B2 * 2/2004 Mulaw ..... 312/245
6,769,552 B1 8/2004 Thalenfeld
6,964,235 B2 11/2005 Hardy
7,028,852 B2 4/2006 Johnson et al.
7,128,379 B1 * 10/2006 LaBonia et al. ..... 312/351
7,395,938 B2 7/2008 Merit et al.
7,424,957 B1 9/2008 Luberto
2003/0217980 A1 11/2003 Johnson et al.
2005/0199564 A1 9/2005 Johnson et al.
2006/0049122 A1 3/2006 Mueller et al.
2006/0201897 A1 9/2006 Mueller et al.
2007/0068885 A1 3/2007 Busto et al.

* cited by examiner

*Primary Examiner* — Darnell Jayne
*Assistant Examiner* — Stanton L Krycinski
(74) *Attorney, Agent, or Firm* — Griffiths & Seaton PLLC

(57) ABSTRACT

Some embodiments of a product display system can be employed in a retail store or other product storage environment to maintain one or more rows of products in an organized manner on a shelf. In some circumstances, the display system can be readily assembled to the shelf and thereafter receive products so that the products can remain visible and advanced toward the front portion of the shelf.

18 Claims, 7 Drawing Sheets

PRODUCT DISPLAY SYSTEM

TECHNICAL FIELD

This disclosure relates to a system for displaying products on a shelf or the like, such as a system that can bias one or more products to advance in a particular direction.

BACKGROUND

Shelves are structures used to support and organize materials of various weights and sizes. Retail stores use shelves for a variety of reasons, such as for making efficient use of space for storage of storefront inventory, and making those items more visible and readily accessible to shoppers. By displaying items in an attractive manner, shoppers may be encouraged to browse and purchase the items. When a shopper takes an item from a row of products on a shelf, the next item remains recessed relative to the front of the shelf, thereby causing the shelf to appear uneven or insufficiently stocked. The remaining, recessed items can also be more difficult for shoppers to access. Some retail store workers may be given the responsibility to manually stock the shelves with new products and to periodically move unsold product toward the front of the shelves.

Dividers can be used to organize rows of items on shelves. By separating rows of items, unintentional disturbance of items in adjacent rows can be reduced when items in a row are handled by workers and shoppers. Consideration must be given, however, to provide enough space around each row for workers to reach behind the rearmost item(s) in order to bring them forward.

In some circumstances, the dividers may include pusher arms that can advance products toward the front of the corresponding shelf. As such, when a product is removed from the front of a row, the pusher arm can advance the remaining products in the row to move forward toward the front of the shelf. When the dividers and other related components are assembled to a shelf, some of the connecting structures are susceptible to breakage (e.g., due to stress concentrations at the connecting structures). Furthermore, some store workers may find difficulty in properly aligning the dividers relative to the shelf and other components during the assembly process.

SUMMARY

Some embodiments of a product display system can be employed in a retail store or other product storage environment to maintain one or more rows of products in an organized manner on a shelf. In some circumstances, the display system can be readily assembled to the shelf and thereafter receive products so that the products can remain visible and advanced toward the front portion of the shelf. The display system can include a divider assembly, which may have a number of mounting structures equipped with support ribs or other supporting features so as to reduce the likelihood of breakage during assembly and removal. In addition, the product display system can include a set of landmarks on a rear support member that corresponding to a set of landmarks on a rear support member, thereby allowing a user to readily assemble the divider assembly to the front and rear support members in an efficient manner.

In particular embodiments, a product display system may include a shelf having a generally horizontal upper surface. The system may also include a front support rail removably mounted to the upper surface of the shelf along a front portion of the shelf. The front support rail may comprise a row of raised projections, which may include a pattern of differently raised projections. The system may further include a rear support rail removably mounted to the upper surface of the shelf along a rear portion of the shelf so that the rear support rail extends generally parallel to the front support rail. The rear support rail may comprise a row of raised projections. The row of raised projections along the rear support rail may include a pattern of differently raised projections that aligns with the pattern of differently raised projections of the front support rail. The system may also include a divider assembly including a spring-biased pusher and a divider arm that is removably mounted to the front and rear support rails in an orientation that is generally perpendicular to the front and rear support rails. The divider arm may comprise a front mounting structure that mates with a selected front slot defined by the row of raised projections of the front support rail, and the divider arm may comprise a rear mounting structure that mates with a selected rear slot defined by the row of raised projections of the rear support rail. The selected front slot may be offset a distance from one of the differently raised projections of the front support rail, and the selected rear slot may be offset substantially the same distance from one of the differently raised projections of the rear support rail.

In some embodiments, a product display system may include front and rear support members to toollessly mount with a shelf in a generally parallel orientation. The rear support member may include a row of raised projections that includes a pattern of differently raised projections. The front support member may include a row of raised projections that includes a pattern of differently raised projections. The pattern of differently raised projections of the front support member may align with the pattern of differently raised projections of the rear support rail when front and rear support members are mounted to the shelf The system may also include a divider assembly including a divider arm and a pusher. The divider arm may removably attach to the front and rear support members in an orientation that is generally perpendicular to the front and rear support members when the front and rear support members are mounted to the shelf The pusher may be biased toward a front portion of the divider arm and is slidably mounted to the divider arm for travel in a longitudinal direction.

Some embodiments include a method of using a product display system. The method may include coupling a rear support member to a rear portion of a shelf, and coupling a front support member to a front portion of the shelf. The method may also include engaging a front hook portion of a divider assembly to the front support member. The method may further include engaging a front mounting structure of the divider assembly in a front engagement site relative to one or more landmarks in the front support member. The method may include aligning a rear mounting structure of the divider assembly to a rear engagement site relative to one or more landmarks in the rear support member that correspond to the one or more landmarks in the front support member. The method may also include engaging the rear mounting structure of the divider assembly with the rear support member at the rear engagement site. The method may further include inserting a plurality of products into a row on the shelf adjacent to the divider assembly so as to move a pusher member the divider assembly rearward toward the rear support member.

The details of one or more embodiments are set forth in the accompanying drawings and the description below. Other features and advantages will be apparent from the description and drawings, and from the claims.

DESCRIPTION OF DRAWINGS

This document describes these and other aspects in detail with reference to the following drawings.

Like reference symbols in the various drawings indicate like elements.

DETAILED DESCRIPTION OF ILLUSTRATIVE EMBODIMENTS

Figure 1:
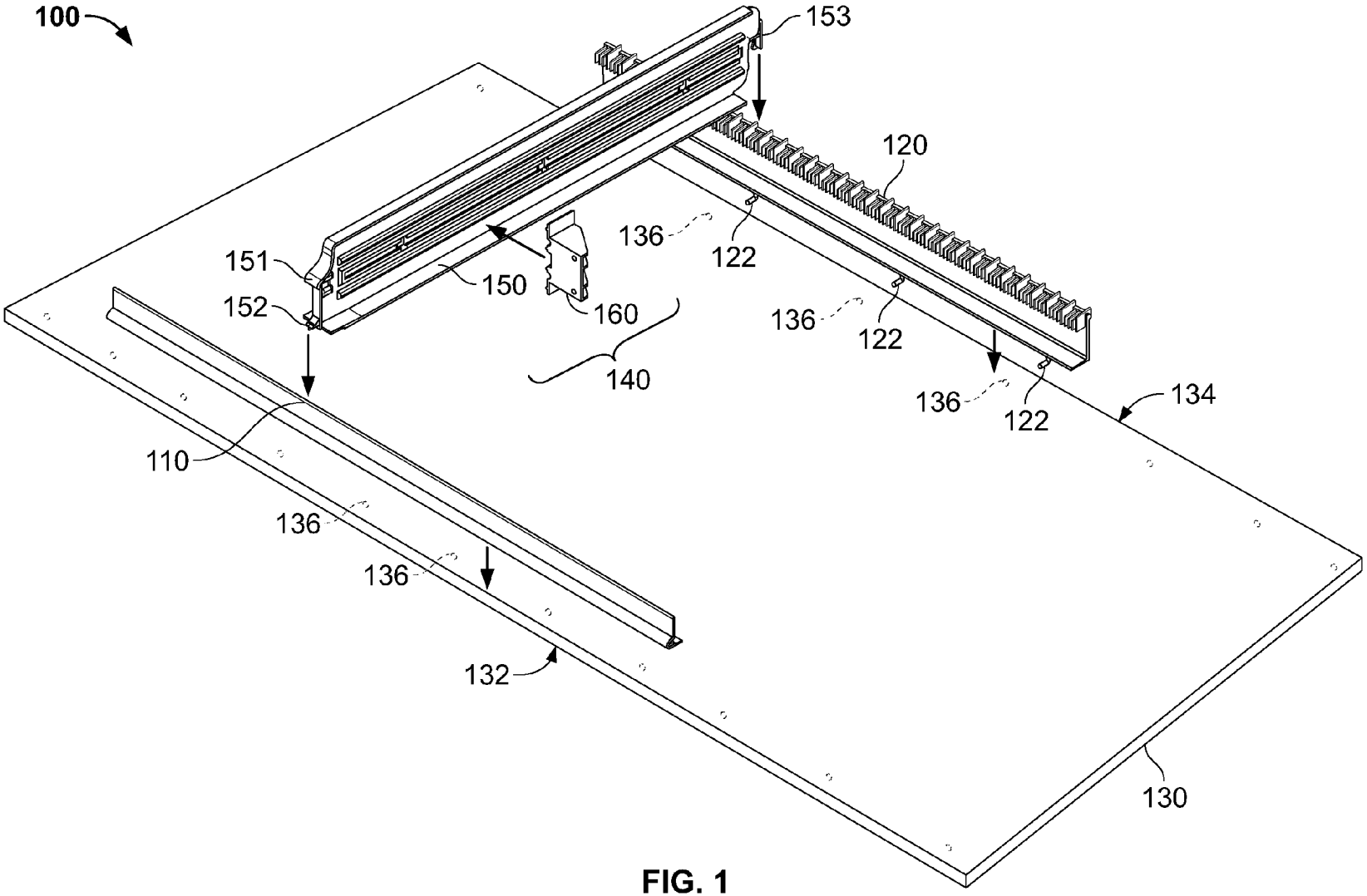
FIG. 1 shows an exploded view of a product display system in accordance with some embodiments.
Figure 2:
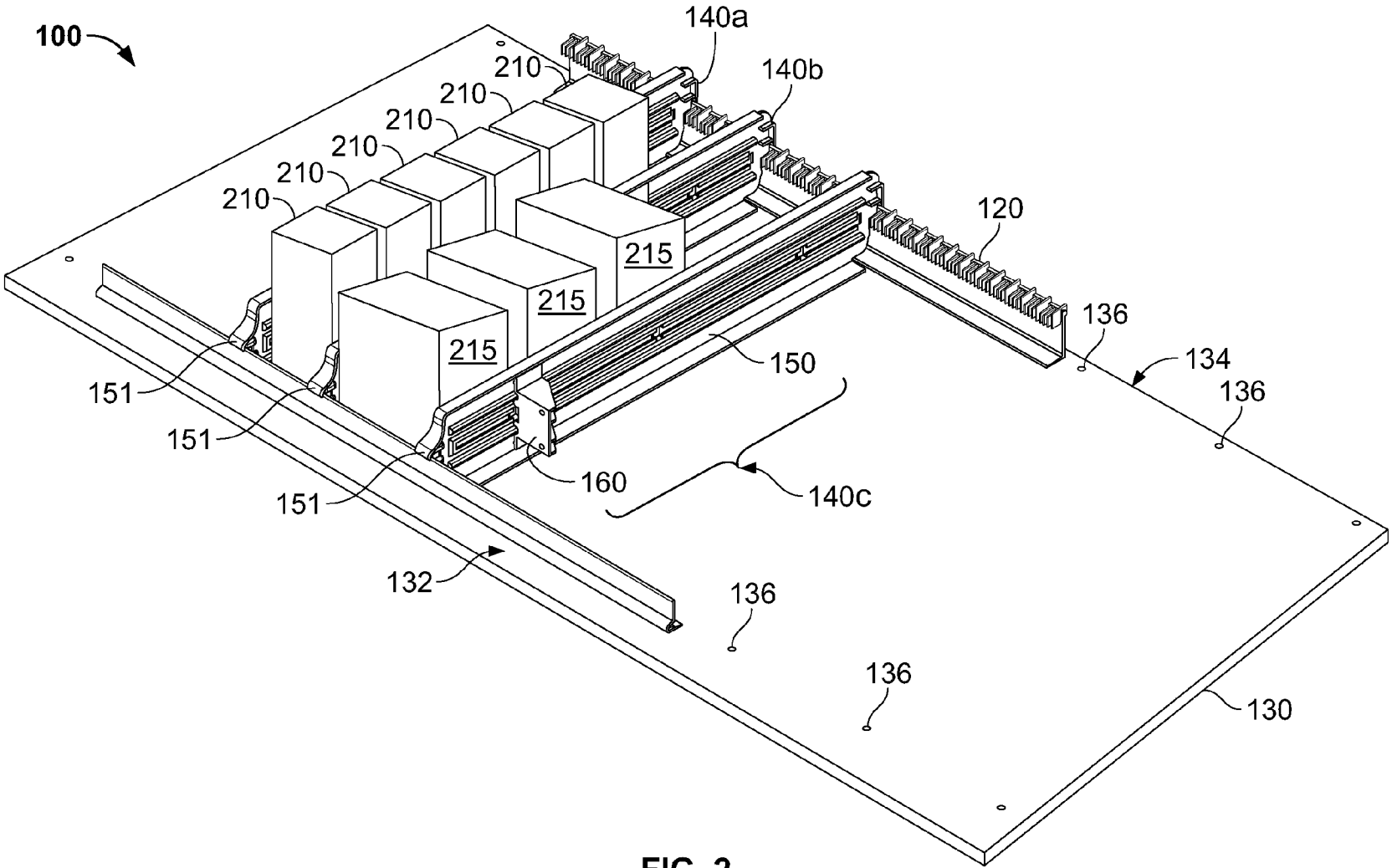
FIG. 2 shows an example of the product display system of FIG. 1 assembled to a shelf

Referring to FIGS. 1-2, a product display system 100 can be employed in a retail store or other product storage environment to maintain one or more rows of products 210 and 215 in an organized manner on a shelf 130. For example, a retail store may use the system 100 with shelved products 210 and 215 (FIG. 2) to urge products 210 and 215 toward a front portion 132 of the shelf 130. As such, the shelf 130 may appear to be fully stocked, making the items more visible and accessible to shoppers. The display system 100 can be readily assembled to the shelf 130 and thereafter receive the products 210 and 215 so that the products 210 and 215 can remain visible and readily accessible without requiring manual reorganization by a store worker or other user.

The display system 100 may include one or more front support members 110, one or more rear support members 120, and at least one divider assembly 140. The front and rear support members 110 and 120 can be coupled to the shelf 130 using mounting structures on the support members 110 and 120 that mate with corresponding structures of the shelf 130. For example, the rear support member 120 can include a number of lower hooks 122 that can be inserted into a corresponding set of shelf holes 136 arranged at a rear portion 134 of the shelf 130. In some examples, the lower hooks 122 can be curved or substantially "L" shaped. As such, the rear support member 120 can be held at a forward angle to the shelf 130 during the insertion of the lower hooks 122 into the shelf holes 136. Then the rear support member 120 can be rotated rearward into a substantially vertical position relative to the shelf 130, thereby engaging the hooks 122 into the holes 136. In this manner, the lower hooks 122 can releasably retain the rear support member 120 in a substantially fixed position relative to the shelf 130. In such circumstances, the rear support ember 120 can be secured to the shelf 130 in a toolless manner (e.g., without the use of handheld tools carried by a worker or other user). The front support member 110 also includes a number of mounting structures, such as "L"-shaped hooks or the like, for releasably securing the front support member 110 to the shelf 130. Such mounting structures are not visible in the FIGS. 1-2 and are described below in connection with FIG. 3A. The hooks or other structures can mate with the holes 136 at the front portion 132 of the shelf 130 so as to substantially retain the front support member 110 relative to the shelf 130.

Still referring to FIGS. 1-2, the divider assembly 140 of the display system 100 can include a divider arm 150 and a pusher 160 that is slidably engaged with the divider arm 150. Each divider arm 150 can be releasably coupled between corresponding front and rear support members 110 and 120. The front and rear support members 110 and 120 engage the divider arm 150 such that the divider arm 150 is oriented substantially perpendicular to the front and rear support members 110 and 120 as well as the top surface of the shelf 130.

The front and rear support members 110 and 120 can maintain the position of the one or more divider assemblies 140 relative to the shelf 130 by providing a number of substantially uniformly spaced, vertically oriented projections 116 and 126 (FIGS. 3A and 4A) for engagement with front and rear mounting structures 152 and 153 of the divider arm 150. The divider arm 150 may also include a front hook 151 that can engage the front support member 110 so as to retain the divider assembly 140 in an operative orientation substantially perpendicular to the front support member 110. During assembly of the divider arm 150 to the front and rear support members 110 and 120, the front and rear mounting structures 152 and 153 of the divider arm 150 may undergo greater stress concentrations than the main body of the divider arm 150. As such, these structures at the front and rear mounting structures 152 and 153 may include ribs or other supporting supplements so as to reduce the likelihood of breakage (described in more detail below in connection with FIGS. 5A-C).

As shown in FIG. 2, a plurality of the divider assemblies 140*a-c* can be adjustably spaced apart to accommodate products 210 and 215 of various widths. For example, two divider assemblies 140*a* and 140*b* can be coupled between the front and rear support members 110 and 120 to form a row that can accommodate a number of products 210 placed on the shelf 130. In the illustrated example, the divider assemblies 140*a* and 140*b* are spaced apart by a user-selected lateral distance to accommodate the width of a row of the products 210. In a similar fashion, the divider assembly 140*c* can be placed in a location adjacent to the divider assembly 140*b* at a different user-selected lateral distance to accommodate a row of the products 215. The divider assemblies 140*a-c* can be spaced apart to form rows that can accommodate the products' 210 and 215 widths while inhibiting the products 210 and 215 from rotating about their vertical axes. For example, by spacing the divider assemblies 140*b* and 140*c* apart by a distance that is slightly wider than the width of the products 215, the row can be sufficiently narrow to prevent the products 215 from being rotated. The products 215 can slide along the length of the row while being maintained in a substantially forward-facing orientation. In such circumstances, the display system 100 can serve to maintain the front labels of the products 210 and 215 more readily visible to shoppers.

Still referring to FIGS. 1-2, the divider assemblies 140*a-c* each include a pusher 160, which in this embodiment is a movable member that is slidably engaged to the corresponding divider arm 150. The pusher 160 can engage the products 210 and 215 to urge them toward the front portion 132 of the shelf 130 (described in more detail below in connection with FIGS. 5A-C and 6-7). For example, the pushers 160 contact a rear face of the rearmost products 210 and 215 in the rows and bias the rows of products 210 and 215 to urge the products 210 and 215 toward the front portion 132 of the shelf 130. The movement of the products 210 and 215 is stopped when the frontmost products 210 and 215 in the rows engage with the front support member 110.

In use, when a shopper or other user removes one or more of the products 210, 215 from the shelf 130, the respective pusher 160 can urge the remaining products 210 and 215 to the front portion 132 of the shelf 130. In some implementations, the pusher 160 can be spring-biased to advance toward the front portion of the divider arm 150 due to one or more spring members, such as a flat coil spring 142 (FIG. 5B). When the pusher 160 advances the remaining products 210 or 215 in a row to engage the front support member 110, the remaining products 210 or 215 can be more visible and readily accessible to shoppers or other users due to a generally uniform, fully-stocked appearance at the front portion 132 of the shelf 130. In some implementations, the amount of manual labor required to maintain the appearance of the shelf 130 can be reduced by using the divider assemblies 140 to move the products 210 and 215 to the front portion 132 of the shelf 130 in an automatic manner (in response to a front product 210 or 215 being removed from the row).

In some examples, the front support member 110, the dividers 140, and other various components of the product display system 100 can be made of a substantially transparent or translucent material. For example, by forming the front support member 110 and the dividers 140*a*-140*c* from a substantially transparent material, more of the front label of the frontmost products 210 and 215 can be readily viewed by shoppers or other users.

Figure 3A:
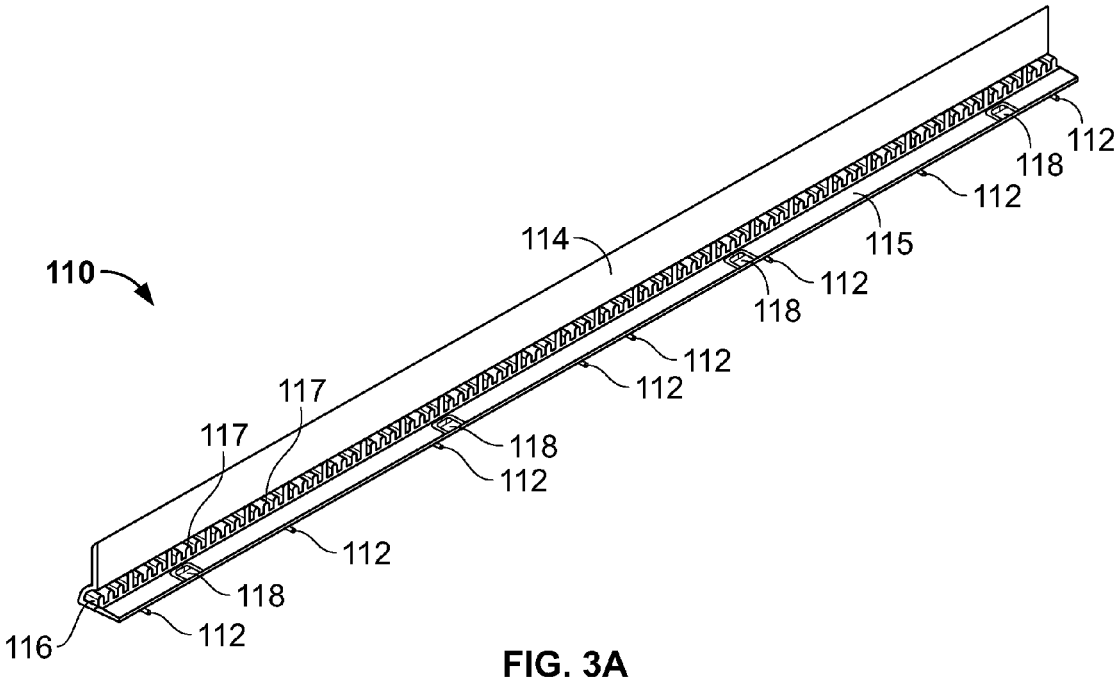
FIGS. 3A and 3B show perspective views of the front support member of the system of FIG. 1, in accordance with some embodiments.
Figure 3B:
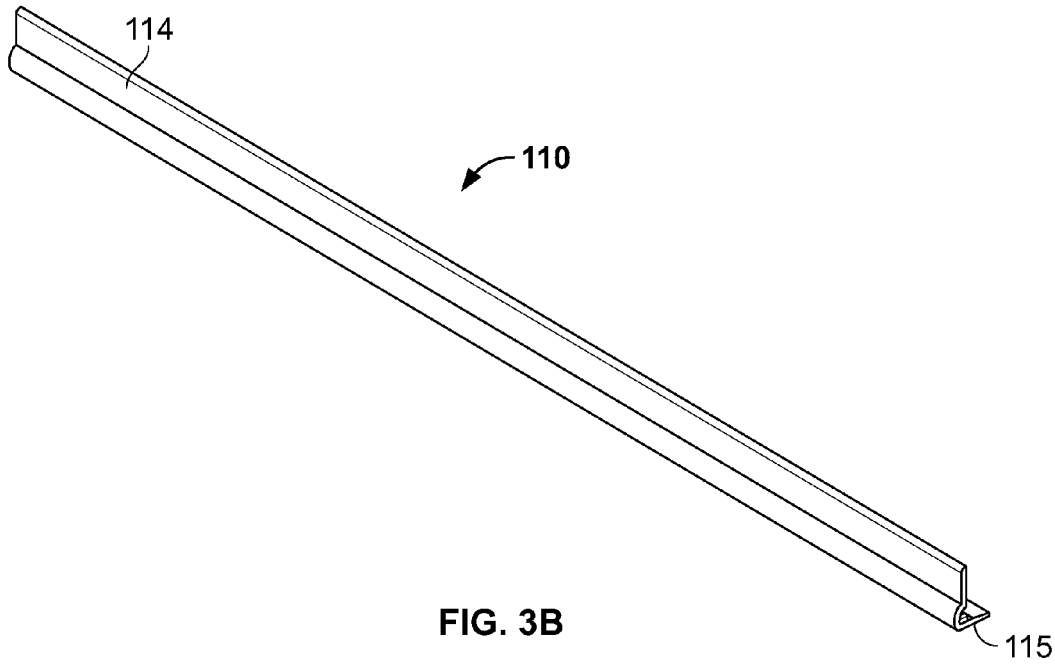

Referring now to FIGS. 3A-B, the front support member 110 may include lower hooks 112 for engagement with the shelf 130 (FIG. 1), as well as a front wall 114, a bottom wall 115, and a row of raised projections 116. In use, a plurality of the front support members 110 may be coupled to the shelf 130 in a side-by-side configuration so as to extend along the front portion 132 of the shelf. The lower hooks 112 of the front support member 110 can be inserted into a corresponding set of shelf holes 136 arranged at the front portion 132 of the shelf 130, and the hooks 112 can be curved or substantially "L" shaped. As such, the front support member 110 can be held at a rearward angle to the shelf 130 during the insertion of the lower hooks 112 into the shelf holes 136 at the front portion 132. Then the front support member 110 can be rotated forward into a substantially vertical position relative to the shelf 130, thereby engaging the hooks 112 into the holes 136 at the front portion 132. Accordingly, the hooks 112 can releasably retain the front support member 110 in a substantially fixed position relative to the shelf 130. Also, in this embodiment, the front support member 110 can be secured to the shelf 130 in a toolless manner (e.g., without the use of handheld tools carried by a worker or other user).

The bottom wall 115 of the front support member 110 can rest on the upper surface of the shelf 130 to provide a stable base for the front support member 110. Optionally, the bottom wall 115 may include mounting holes 118 that can be used with fasteners to couple the front support member 110 to the shelf 130 (in addition to, or in lieu of, of the lower hooks 112). For example, the mounting holes 118 can be aligned with a set of shelf holes 136 at a front portion 132 of the shelf 130, and push pins, rivets, screws, nails, or other fasteners can be inserted through the mounting holes 118 into the shelf holes 136 to couple the front support member 110 to the shelf 130.

The front wall 114 of the front support member 110 may extend generally upward and perpendicular to the upper surface of the shelf 130 (when the member 110 is engaged with the shelf 130). As such, the front wall 114 can receive the front hook portion 151 of the divider arm 150 (FIG. 2), thereby supporting the divider arm 150 in an orientation that is generally perpendicular to the front support member 110 and generally perpendicular to the upper surface of the shelf 130. In addition, the front wall 114 may serve as a stop for the frontmost products 210 and 215 that are advanced toward the front portion 132 of the shelf 130. Thus, when a pusher 160 (FIGS. 1-2) causes a row of products 210 or 215 to advance toward the front portion 132 of the shelf 130, the front wall 114 engages the frontmost product 210 or 215 so as to stop the forward movement.

As shown in FIG. 3A, the front support member 110 includes the row of raised projections 116 at a predetermined height so as to mate with the front mounting structure 152 of the divider arm 150. As such, the raised projections 116 define a set of slots that can releasably retain the front mounting structure 152 to maintain the divider assembly 140 at a selected position along the length of the front support member 110. Included in the row of raised projections 116 are one or more periodically spaced, differently raised projections 117. The differently raised projections 117 appear different (e.g., a greater or lesser height, a different color, or the like) from the other projections 116 in the row and may occur in a predetermined pattern. In addition, the differently raised projections 117 can be viewed through the front wall 114 (refer for example, to FIG. 6) when the front support member 110 comprises a substantially transparent or translucent material. In the illustrative example depicted in FIG. 3A, the pattern of differently raised projections 117 is defined by every fourth member in the row of raised projections 116 being noticeably taller than its neighbors. In some implementations, the differently raised projections 117 can be taller or shorter than the other raised projections in the row 116. In some implementations, the differently raised projections 117 can be spaced apart by one, two, three, four, five, ten, twenty, or any other number of intermediate raised projections. As will be discussed below in connection with FIGS. 6 and 7, the differently sized projections 117 can be used to help align the divider assembly 140 relative to the front and rear support members 110 and 120 during assembly of the product display system 100.

Figure 4A:
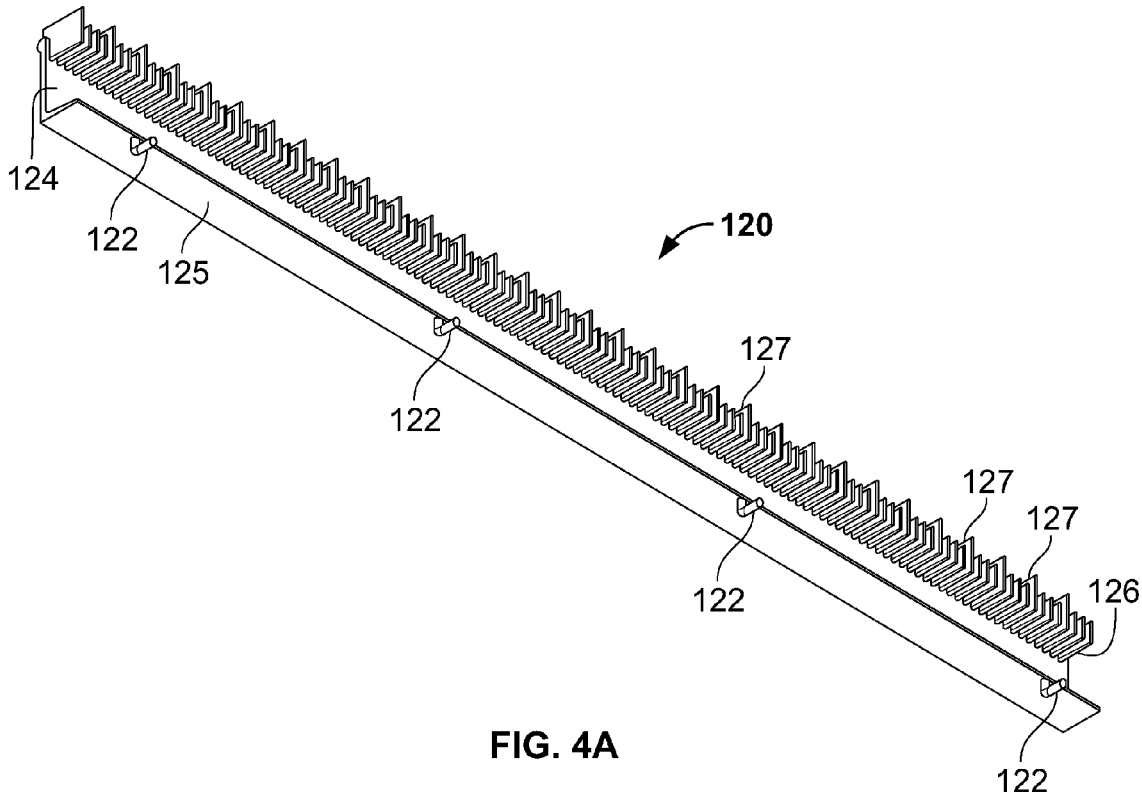
FIGS. 4A and 4B show perspective views of the rear support member of the system of FIG. 1, in accordance with some embodiments.
Figure 4B:
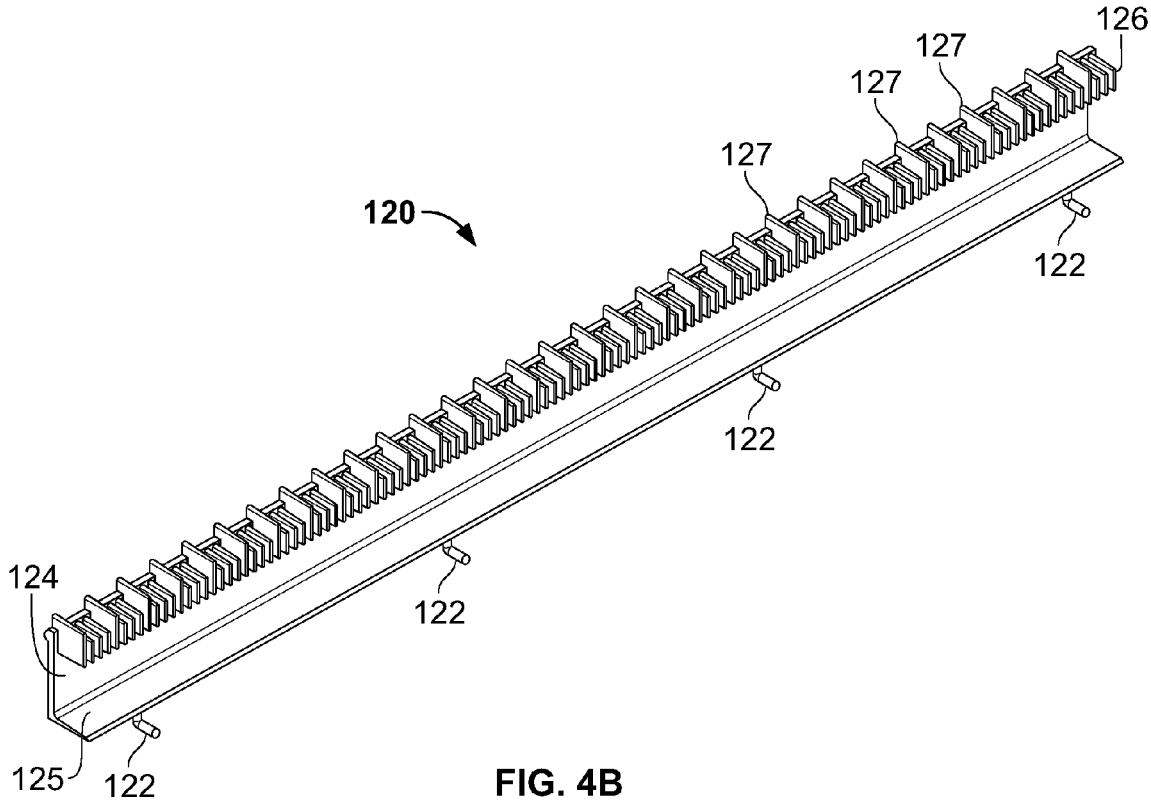

Referring now to FIGS. 4A and 4B, some embodiments of the rear support member 120 may include the lower hooks 122, a rear wall 124, a bottom wall 125, and a row of raised projections 126 extending along the rear wall 124. In use, a plurality of the rear support members 120 may be coupled to the shelf 130 in a side-by-side configuration so as to extend along the rear portion 134 of the shelf 130. The lower hooks 122 of the rear support member 120 can be inserted into a corresponding set of shelf holes 136 arranged at the rear portion 134 of the shelf 130, and the hooks 122 can be curved or substantially "L" shaped (as previously described in connection with FIG. 1). In this embodiment, the hooks 122 can releasably retain the rear support member 120 (in a toolless manner) in a substantially fixed position relative to the shelf 130.

The bottom wall 125 of the rear support member 120 can rest on the upper surface of the shelf 130 to provide a stable base for the rear support member 120. Optionally, the bottom wall 125 may include mounting holes (similar to holes 118 in FIG. 4A) that can be used with fasteners to couple the rear support member 120 to the shelf 130 (in addition to, or in lieu of, of the lower hooks 122). The rear wall 124 of the rear support member 120 may extend generally upward and perpendicular to the upper surface of the shelf 130 (when the member 120 is engaged with the shelf 130). As such, the rear wall 124 can receive the rear mounting structure 153 of the divider arm 150 (refer to FIG. 2).

Because the divider assembly 140 is releasably coupled to both the front support member 110 and the rear support member 120, the worker or other installer may attempt to visually align the divider arm 150 in a position that is generally perpendicular to both the front support member 110 and the rear support member 120. As described herein, such a may process can be more efficiently accomplished due to the row of raised projections 126 (having a pattern of differently raised projections 127) that corresponds to the pattern of raised projections 116, 117 (FIG. 3A) of the front support member 110.

Still referring to FIGS. 4A-B, the rear support member 120 includes the row of raised projections 126 at a predetermined height so as to mate with the rear mounting structure 153 of the divider arm 150 (FIG. 2). The raised projections 126 define a set of slots that can releasably retain the rear mounting structure 153, which in this example comprises a downward extending hook arm. The mating connection between the rear mounting structure 153 and the raised projections 126 can serve to maintain the divider assembly 140 at a selected position along the length of the rear support member 120. Included in the row of raised projections 126 are one or more periodically spaced, differently raised projections 127. The differently raised projections 127 appear visually different (e.g., a greater or lesser height, a different color, or the like) from the other projections 126 in the row and may occur in a predetermined pattern. In the illustrative example depicted in FIGS. 4A-B, the pattern of differently raised projections 127 is defined by every fourth member in the row of raised projections 126 being noticeably taller than its neighbors (e.g., a pattern that corresponds to the pattern of differently raised projections 117 for the front support member 110). In some implementations, the differently raised projections 127 can be taller or shorter than the other raised projections in the row 126. In some implementations, the differently raised projections 127 can be spaced apart by one, two, three, four, five, ten, twenty, or any other number of intermediate raised projections. As will be discussed below in connection with FIGS. 6 and 7, the differently sized projections 127 can be used to help align the divider assembly 140 relative to the front and rear support members 110 and 120 during assembly of the product display system 100.

Figure 5A:
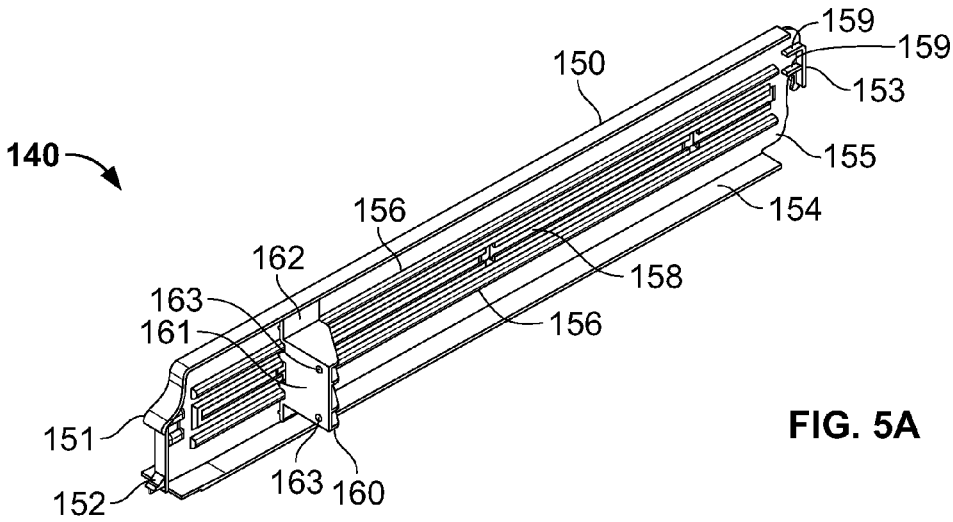
FIGS. 5A, 5B, and 5C show perspective views of the divider of the system of FIG. 1, in accordance with some embodiments.
Figure 5B:
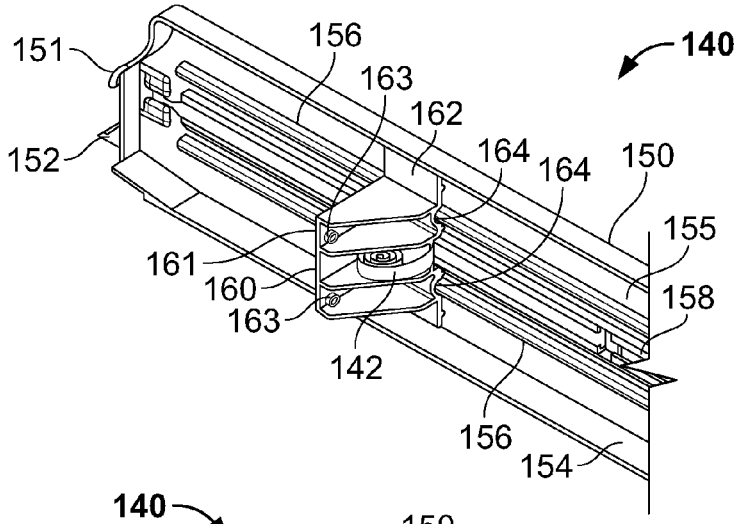
Figure 5C:
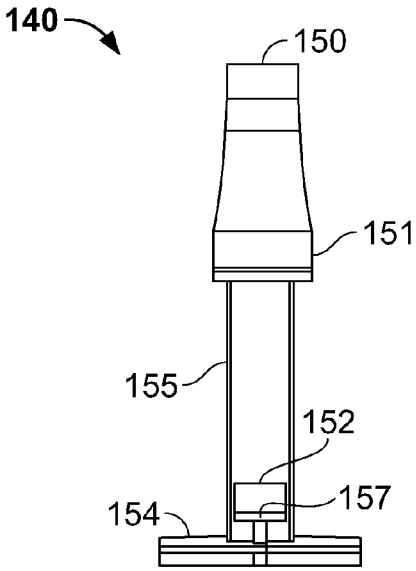

Referring now to FIGS. 5A-5C, the divider assembly 140 includes the divider arm 150 and the pusher 160 that is guided along a side surface of the divider arm 150 (the pusher 60 is removed from view in FIG. 5C). The divider arm 150 includes the front hook portion 151 to engage the front wall 114 of the front support member 110 (FIG. 3A). In this embodiment, the front hook portion 151 includes a downward extending hook that is substantially wider than the main body of the divider arm 150. Also, the divider arm may include the front mounting structure 152 that mates with a selected slot defined by the row of raised projections 116 (FIG. 3A). Furthermore, the divider arm 150 can include the rear mounting structure 153 that mates with a selected slot defined by the row of raised projections 126 (FIG. 4A).

In some embodiments, these mounting structures 151, 152, and 153 may include supplemental support features that can reduce the likelihood of breakage during assembly (or removal) of the divider arm 150 to the front and rear support members 110 and 120. For example, the front hook portion 151 can include a wide nose having a lateral width that is greater than the lateral width of the main body of the divider arm 150. Thus, as shown in FIG. 5C, the front hook 151 can extend laterally outward beyond both sides of the vertical portion 155 of the divider arm 150. The front hook portion 151 having the widened nose feature can firmly secure to the front support member 110 while also bearing significant stress loads during assembly and removal, thereby reducing the likelihood of breakage.

In another example, the front mounting structure 152 can include a vertical tab that mates within a selected slot (defined by the raised projections 116 of the front support member 110) and can further include a support rib 157 (FIG. 5C) extending horizontally relative to the vertical tab (e.g., providing a T-shaped cross-section in this embodiment). The support rib 157 can increase the strength of the front mounting structure 152 (thereby reducing the likelihood of breakage during assembly and removal) without interfering with the mating connection between the vertical tab and the raised projections 116. Furthermore, the support rib 157 can extend in a generally horizontal direction so as to abut with the top a pair of projections 116 in the front support member 110 (FIG. 3A) while the vertical tab portion rests in a slot defined by the pair of projections 116. Such a configuration facilitates proper alignment of the divider assembly 140 relative to the front support member 110.

In yet another example, the rear mounting structure 153 can comprise a downward extending hook that is supported by one or more ribs 159. The ribs 159 extend generally horizontally relative to the hook arm in this embodiment. Here again, the ribs 159 can increase the strength of the of the rear mounting structure 153 (thereby reducing the likelihood of breakage during assembly and removal) without interfering with the mating connection between the downward hook 153 and the raised projections 126 of the rear support member 120. Furthermore, at least one of the support ribs 159 can extend in a generally horizontal direction so as to abut with the top of a pair of projections 126 in the rear support member 120 (FIG. 4A) while the downward hook portion rests in a slot defined by the pair of projections 126. Such a configuration facilitates proper alignment of the divider assembly 140 relative to the rear support member 120.

As shown in FIGS. 5A-B, the pusher 160 includes a front wall 161 and a sliding wall 162. The sliding wall 162 of the pusher 160 includes one or more channels 164 that mate with a corresponding number of rails 156 in the vertical wall 155 of the divider arm 150. The rails 156 of the divider arm may be substantially congruent to one another about a longitudinal axis of the divider arm 150. Thus, as shown in FIG. 5A, the upper rail 156 can be offset from the central axis of the divider arm 150, and the lower rail 156 can have a substantially similar offset from the central axis of the divider arm 150. In some embodiments, the pusher 160 may include a retaining finger that is slidably retained within a track 158 of the vertical wall 155. In use, the sliding wall 162 of the pusher 160 remains in sliding with the vertical wall 155 while allowing the pusher 160 to slide longitudinally along rails 156 of the divider arm 150. Likewise, when the sliding wall 162 of the pusher 160 is brought into contact with the vertical wall 155, the rails 156 and channels 164 can mate to prevent rotation of the pusher 160 relative to the divider arm 150. In some implementations, the rails 156, channels 164, the track 158, and the retaining finger of the pusher 160 can have a different structure than those illustrated in FIGS. 5A-5B. For example, the sliding wall 162 can include one or more raised rails that mate with one or more corresponding channels or grooves in the vertical wall 155.

The divider assembly 140 also includes spring member 142 to bias the pusher 160 toward a forward position along the divider arm 150. The spring member 142 may comprise a flat coil spring 142 (FIG. 5B) that is mounted at one end to the divider arm 150 (near the front hook portion 151) and at the other end to the pusher 160. As such, an uncoiled portion of the spring 142 may be disposed along the track 158 of the divider arm 150, and a coiled portion of the spring 142 may be disposed in a rear cavity defined by the pusher 160. When the products 210 or 215 are added to the row (FIG. 2) so as to force the pusher 160 rearward along the divider arm 150, the spring 142 biases the pusher 160 to press against the rearmost product 210 or 215 so as to urge the row of the products 210 or 215 toward the front support member 110 (and thus toward the front portion 132 of the shelf 130). It should be understood from the description herein, that in some implementations, the spring member 142 may comprise a biasing member other than a flat coil spring, such as an elastic band, a coil spring, or the like.

In some implementations, the pusher 160 can also include mounting holes 163 to removably receive extender brackets (not shown in FIGS. 5A-B). Such extender brackets can be used to increase product-abutting area of the pusher face, thereby enabling the pusher 160 to effectively move products having larger package sizes. For example, an extender bracket can be mounted to the front wall 161 via fasteners that are received in the mounting holes 163 to provide a wider surface to contact products that are wider than the products 210 and 215. In another example, an extender bracket can be mounted to the front wall 161 to provide a surface for contacting cylindrical or otherwise rounded products.

Figure 6:
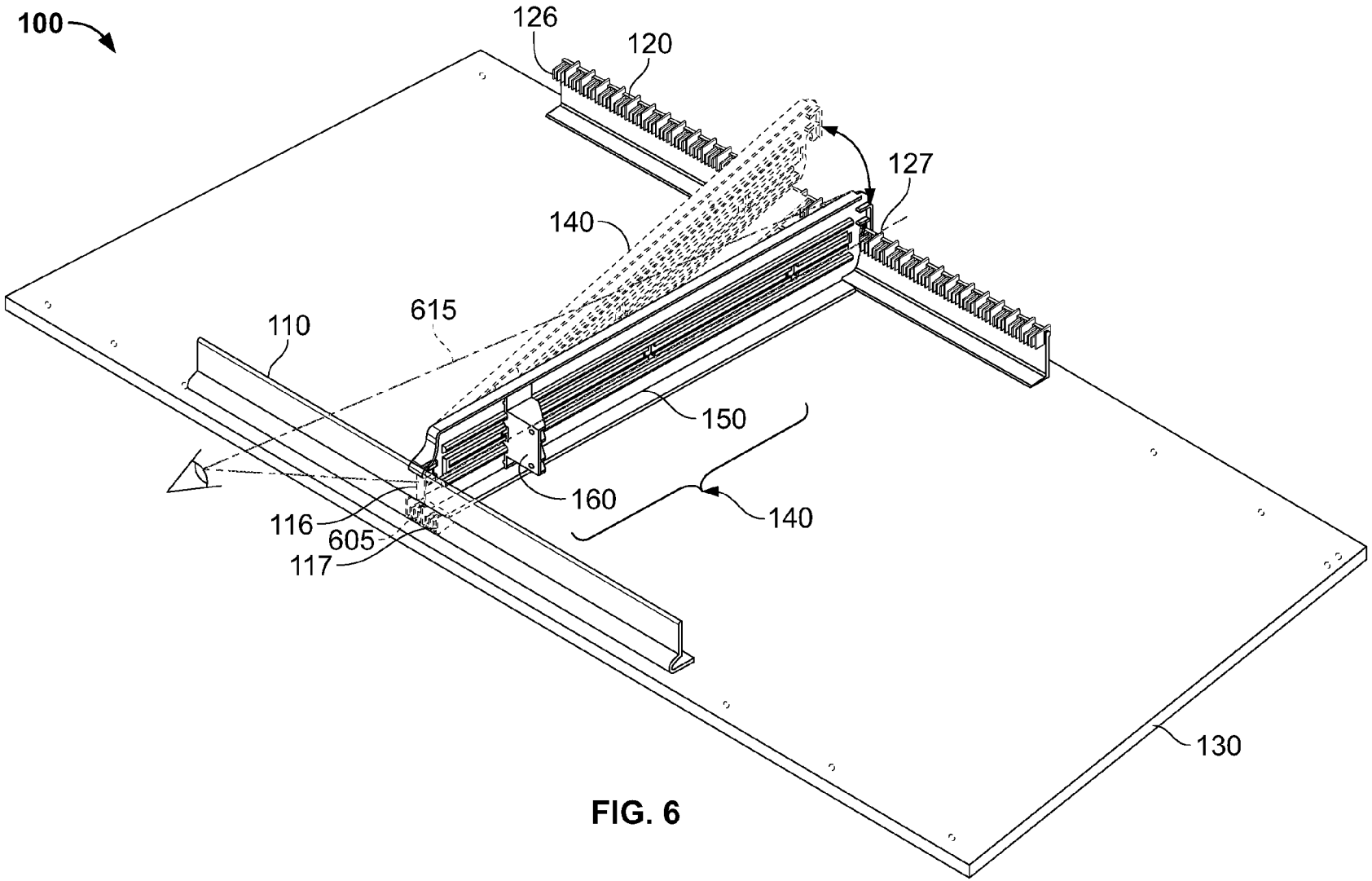
FIG. 6 shows a perspective view of a divider being assembled to support members of a product display system, in accordance with some embodiments.

Referring now to FIG. 6, the divider assembly 140 is being assembled into the product display system 100. In use, a store worker or other user generally selects a location along the length of the front support member 110 to mount the divider assembly 140. The store worker can engage the front hook portion 151 with the front support member 110, while keeping the rear mounting structure 153 of the divider arm 150 somewhat elevated above the rear support member 120. As the store worker lowers the rear of the divider assembly 140, the front mounting structure 152 becomes engaged between two of the projections 116 in the front support member 110. At this stage, the store worker can readily observe the front engagement location 605 relative to a nearby differently raised projection 117 in the front support member 110. For example, the store worker can conveniently count the number of projections 116 by which the front engagement location 605 is offset from the nearby differently sized projection 117 in the front support member 110.

The store worker can then look past the differently sized projection 117, along a line of sight 615, to locate a corresponding differently sized projection 127 on the rear support member 120. Accordingly, the store worker can readily correlate the location of the differently sized projection 117 (near the first engagement location 605) to a rear location of the corresponding differently sized projection 127 along the rear support member 120. From there, the store worker can count a number of projections 126 offset from the differently sized projection 127, wherein the offset is equal to number of projections 116 offset from the differently sized projection 117 near the first engagement location 605. In such circumstances, the store worker can promptly and accurately locate the rear engagement location 610 that provides a generally perpendicular orientation between the divider arm 150 and the front and rear support members 110 and 120. The store worker can then lower the divider assembly 140 so that the rear mounting structure 153 engages the rear support member 120 at the rear engagement location 610. Thus, the installer can readily visualized the differently sized projections 117 and 127 (on the front and rear support members 110 and 120) to properly align the divider arm without the need for repeated guesses and attempts.

Figure 7:
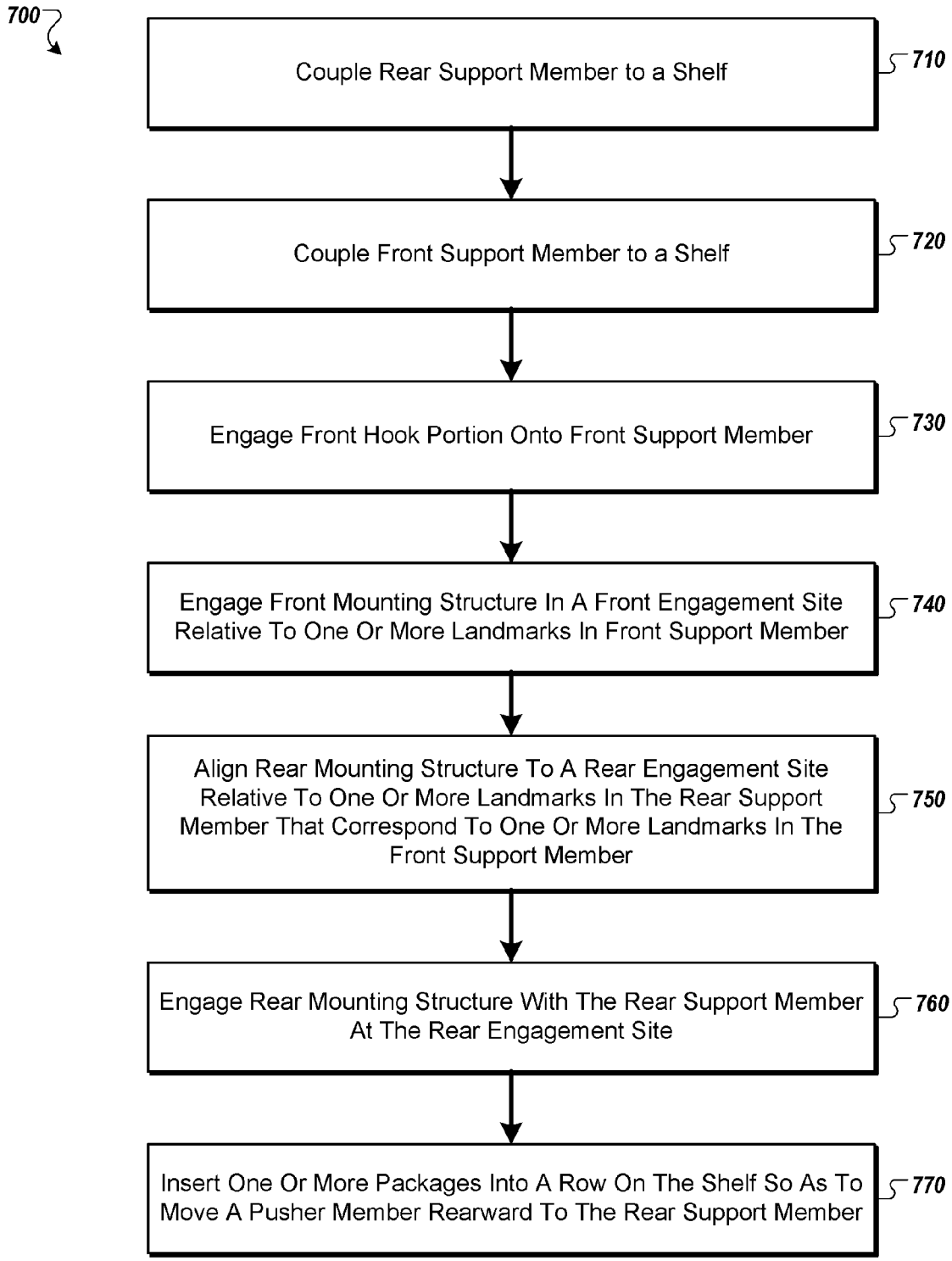
FIG. 7 illustrates a flow chart of an exemplary process for assembling the product display system 100 to the shelf 130, in accordance with some embodiments.

FIG. 7 illustrates a flow chart of an exemplary process 700 for assembling the product display system 100 to the shelf 130. The process 700 may include operation 710 in which a store worker or other user couples a rear support member 120 to a shelf 130. For example, the rear support member 120 can be coupled to the shelf 130 using the lower hooks 122 that mate with the holes 136 at the rear portion 134 of the shelf 130. In operation 720, the user couples a front support member 110 to the shelf 130. In one example, the front support member 110 can be coupled to the shelf 130 using the lower hooks 112 that mate with the holes 136 at the front portion 132 of the shelf 130. In operation 730, the user may engage a front hook portion 151 of a divider assembly 140 onto the front support member 110.

In operation 740, the user may engage a front mounting structure 152 of the divider assembly 140 in a front engagement site 605 relative to one or more landmarks in the front support member. For example, the front support member 110 may include the row of raised projections 116 to receive the front mounting structure 152, and the differently sized projections 117 of the front support member 110 may serve as landmarks for the front engagement site. In operation 750, the user may align a rear mounting structure 153 to a rear engagement site 610 relative to one or more landmarks in the rear support member 120 that correspond to the one or more landmarks in the front support member 110. For example, the rear support member 120 may include the row of raised projections 126 to receive the rear mounting structure 153, and the differently sized projections 127 of the rear support member 120 may serve as landmarks for the rear engagement site 610. As previously described, such an operation enables the user to promptly and accurately locate the rear engagement location 610 and thereby provides a generally perpendicular orientation between the divider arm 150 and the front and rear support members 110 and 120.

In operation 760, the user may engage the rear mounting structure 153 with the rear support member 120 at the rear engagement site 610. For example, the rear mounting structure 153 may comprise a downwardly extending hook that mates with a selected slot defined by two of the raised projections 126 in the rear support member 120. In some implementations, the rear mounting structure 153 and the rear support member 120 can be formed such that the user can feel tactile snap, or hear an audible click, when the two components engage one another.

In operation 770, the user may insert one or more packages (e.g., the products 210 and 215) into a row on the shelf 130 so as to move a pusher member rearward toward the rear support member 120. In one example, the pusher member may comprise the spring-biased pusher 160 that movably engages the divider arm so as to travel in a longitudinal direction between forward and rearward positions. Accordingly, if a product is removed from the row, the pusher 160 can advance the remaining products in the row toward the front support member 110. The remaining products in the row can be more visible and readily accessible to shoppers or other users due to a generally uniform, fully-stocked appearance at the front portion 132 of the shelf 130.

A number of implementations have been described. Nevertheless, it will be understood that various modifications may be made without departing from the spirit and scope. Accordingly, other implementations are within the scope of the following claims.

What is claimed is:

1. A product display system, comprising:

a shelf having a generally horizontal upper surface;

a front support rail removably mounted to the upper surface of the shelf along a front portion of the shelf, wherein the front support rail comprises a row of raised projections, the row of raised projections including a pattern of differently raised projections;

a rear support rail removably mounted to the upper surface of the shelf along a rear portion of the shelf so that the rear support rail extends generally parallel to the front support rail, wherein the rear support rail comprises a row of raised projections, the row of raised projections along the rear support rail including a pattern of differently raised projections that aligns with the pattern of differently raised projections of the front support rail; and a divider assembly including a spring-biased pusher and a divider arm that is removably mounted to the front and rear support rails in an orientation that is generally perpendicular to the front and rear support rails, the divider arm comprising a front mounting structure that mates with a selected front slot defined by the row of raised projections of the front support rail, and the divider arm comprising a rear mounting structure that mates with a selected rear slot defined by the row of raised projections of the rear support rail, wherein the selected front slot is offset a distance from one of the differently raised projections of the front support rail, and the selected rear slot is offset substantially the same distance from one of the differently raised projections of the rear support rail;

wherein the pattern of differently raised projections of the front support rail includes differently raised projections of at least one different height than other raised projections in the row of raised projections of the front support rail to visually differentiate the differently raised projections from the other raised projections in the row of raised projections of the front support rail.

2. The system of claim 1, wherein the front mounting structure includes a vertical tab and an integral support rib.

3. The system of claim 2, wherein the vertical tab of the front mounting structure mates with the selected front slot defined by the row of raised projections of the front support rail, and the integral support rib extends substantially horizontally to abut with at least one of the raised projections of the front support rail.

4. The system of claim 1, wherein the rear mounting structure includes a downwardly extending hook and one or more integral support ribs.

5. The system of claim 4, wherein the downwardly extending hook of the rear mounting structure mates with the selected rear slot defined by the row of raised projections of the rear support rail, and the one or more integral support ribs extend substantially horizontally to abut with at least one of the raised projections of the rear support rail.

6. The system of claim 1, wherein the divider arm comprises a front hook extending from a vertical wall to engage the front rail, the front hook comprising a downwardly extending nose portion that extends laterally outward on both side of the vertical wall of the divider arm.

7. The system of claim 1, wherein the front support rail comprises a substantially transparent or translucent material.

8. A product display system, comprising:

front and rear support members to removably mount with a shelf in a generally parallel orientation, the rear support member comprises a row of raised projections that includes a pattern of differently raised projections, and the front support member comprises a row of raised projections that includes a pattern of differently raised projections, wherein:

the pattern of differently raised projections of the rear support member includes differently raised projections of at least one different height than other raised projections in the row of raised projections of the rear support member, the pattern of differently raised projections of the front support member includes differently raised projections of at least one different height than other raised projections in the row of raised projections of the front support member, and the pattern of differently raised projections of the front support member aligns with the pattern of differently raised projections of the rear support member when front and rear support members are mounted to the shelf; and a divider assembly including a divider arm that removably attaches to the front and rear support members in an orientation that is generally perpendicular to the front and rear support members when the front and rear support members are mounted to the shelf, the divider assembly including a pusher that is biased toward a front portion of the divider arm and is slidably mounted to the divider arm for travel in a longitudinal direction.

9. The system of claim 8, wherein the divider arm comprises a front hook extending from a vertical wall to engage the front support member, the front hook comprising a downwardly extending nose portion that extends laterally outward on both sides of the vertical wall of the divider arm.

10. The system of claim 8, wherein the divider arm comprises a front mounting structure that includes a vertical tab and an integral support rib.

11. The system of claim 10, wherein the vertical tab of the front mounting structure mates with a selected slot defined by the front support member.

12. The system of claim 8, wherein the divider arm comprises a rear mounting structure that includes a downwardly extending hook and one or more integral support ribs.

13. The system of claim 12, wherein the downwardly extending hook of the rear mounting structure mates with a selected slot defined by the rear support member.

14. The system of claim 8, wherein the front and rear support members are removably mounted on a support surface of the shelf 15. The system of claim 14, wherein the shelf comprises a set of mounting holes extending along a front portion of the shelf to receive lower hooks of the front support member and a set of mounting holes extending along a rear portion of the shelf to receive lower hooks of the rear support member.

16. The system of claim 8, wherein the front support member comprises a substantially transparent or translucent material.

17. The product display system of claim 1, wherein:

the pattern of differently raised projections of the front support rail includes a differently raised projection located a first number of other raised projections of the front support rail away from an adjacent differently raised projection in the row of raised projections of the front support rail, and the pattern of differently raised projections of the rear support rail includes a differently raised projection located the first number of other raised projections of the rear support rail away from an adjacent differently raised projection in the row of raised projections of the rear support rail.

18. The product display system of claim 1, wherein:

the divider arm includes a vertical wall defining at least two raised rails and a track between the at least two raised rails, the spring-biased pusher includes a sliding wall including at least two channels that mate with the at least two raised rails, and the sliding wall extends above an upper one of the at least two channels to interface with the vertical wall and extends below a lower one of the at least two channels to interface with the vertical wall.

* * * * *